US007591681B1

(12) United States Patent
Zhang et al.

(10) Patent No.: US 7,591,681 B1
(45) Date of Patent: Sep. 22, 2009

(54) SENSOR CONNECTOR ASSEMBLY

(75) Inventors: George(Huanyl) Zhang, Irvine, CA (US); Jeff Pan, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/229,629

(22) Filed: Aug. 25, 2008

(51) Int. Cl.
*H01R 33/09* (2006.01)

(52) U.S. Cl. ..... 439/620.24

(58) Field of Classification Search ..... 439/620.24, 439/913; 361/103, 697
See application file for complete search history.

(56) References Cited

U.S. PATENT DOCUMENTS 5,124,880 A * 6/1992 Okamoto et al. ..... 361/306.1
5,246,389 A * 9/1993 Briones ..... 439/620.1
5,769,667 A * 6/1998 Belopolsky ..... 439/620.1
6,045,405 A 4/2000 Geltsch
7,074,089 B2 * 7/2006 Kajiura et al. ..... 439/620.01

* cited by examiner

*Primary Examiner*—Jean F Duverne
(74) *Attorney, Agent, or Firm*—Wei Te Chung

(57) ABSTRACT

A sensor connector assembly includes an extender having a base defining opposite first and second mating faces (101, 201), a chamber (3) standing upon a top wall (30) of the base of the extender; a thermal sensing device received in the chamber (3). This thermal sensing device is configured to measure the environment temperature where the connector assembly is located so as to decide when to startup a cooling system for the connector assembly.

8 Claims, 5 Drawing Sheets

SENSOR CONNECTOR ASSEMBLY

BACKGROUND OF THE INVENTION

1. Field of the Invention

The present invention generally relates to an electrical connector assembly, and more particularly to an electrical connector assembly equipped with a thermal sensing device adapted to measure the temperature where the electrical connector assembly is located so as to decide when to startup a cooling system.

2. Description of Related Art

To keep electronic circuits and computers work under certain temperature is a common practice in our daily life. It will consume power to conduct the heat away. Due to power saving in electronic computers and equipment is good for environment. An electrical connector assembly is expected to be equipped with a temperature or thermal sensor to measure the temperature where the electrical connector assembly is located so as to decide when to startup a cooling system, which is provided for cooling the environment of the electrical connector assembly.

BRIEF SUMMARY OF THE INVENTION

A sensor connector assembly according to an embodiment of the present invention comprises an extender including a base defining opposite first and second mating faces, the second mating face different from the first mating face; a chamber standing upon a top wall of the base of the extender; a thermal sensing device received in the chamber; and a cover assembled onto the chamber for covering the thermal sensing device, the cover defining a plurality of through holes to communicate the thermal sensing device with the outside. This thermal sensing device is configured to measure or sense the temperature where the connector assembly is located so as to decide when to startup a cooling system for the connector assembly.

Other objects, advantages and novel features of the invention will become more apparent from the following detailed description of the present embodiment when taken in conjunction with the accompanying drawings.

DETAILED DESCRIPTION OF PREFERRED EMBODIMENT

Figure 1:
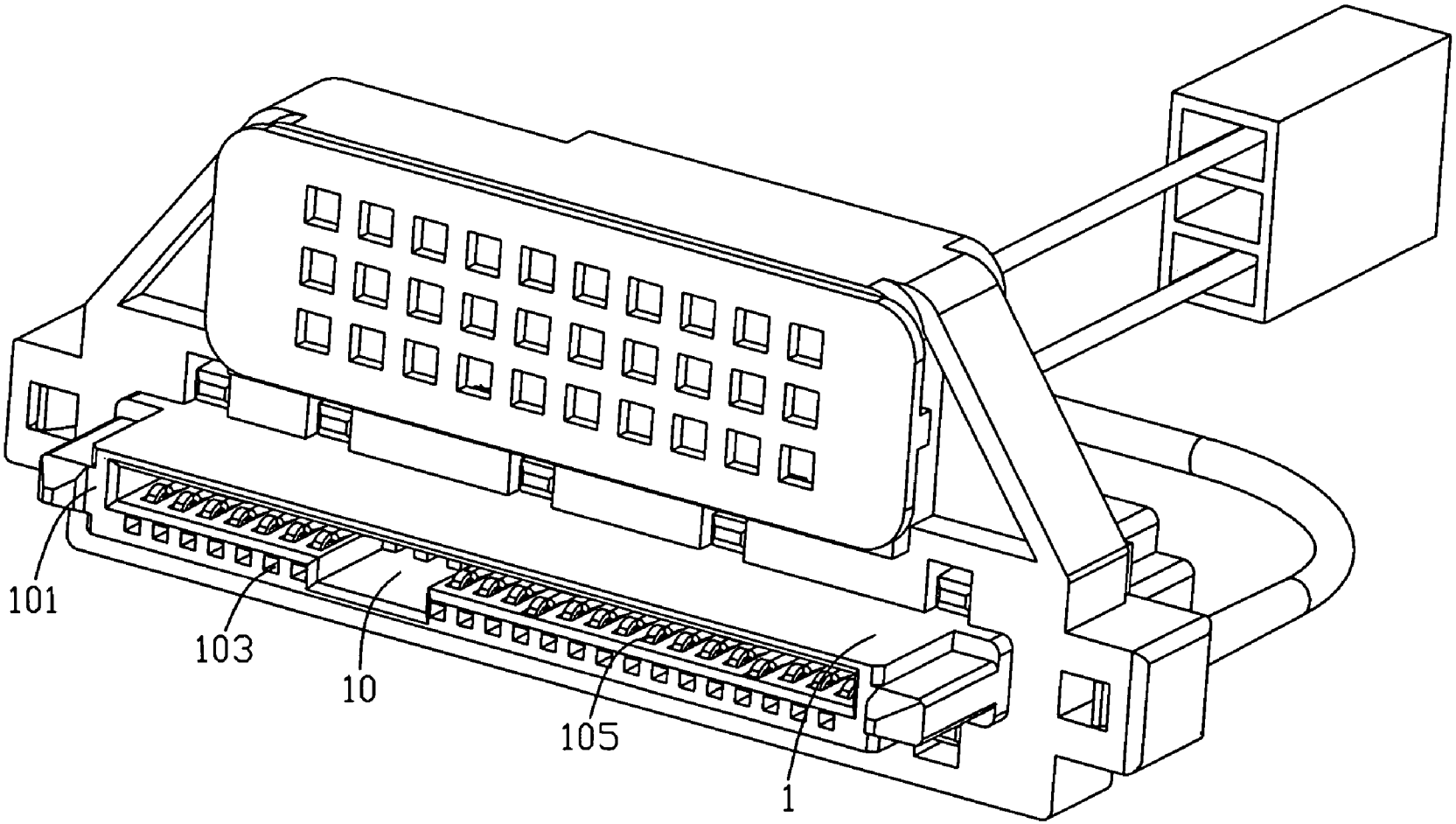
FIG. 1 is an assembled, perspective view of a sensor connector assembly in accordance with a preferred embodiment of the present invention.
Figure 2:
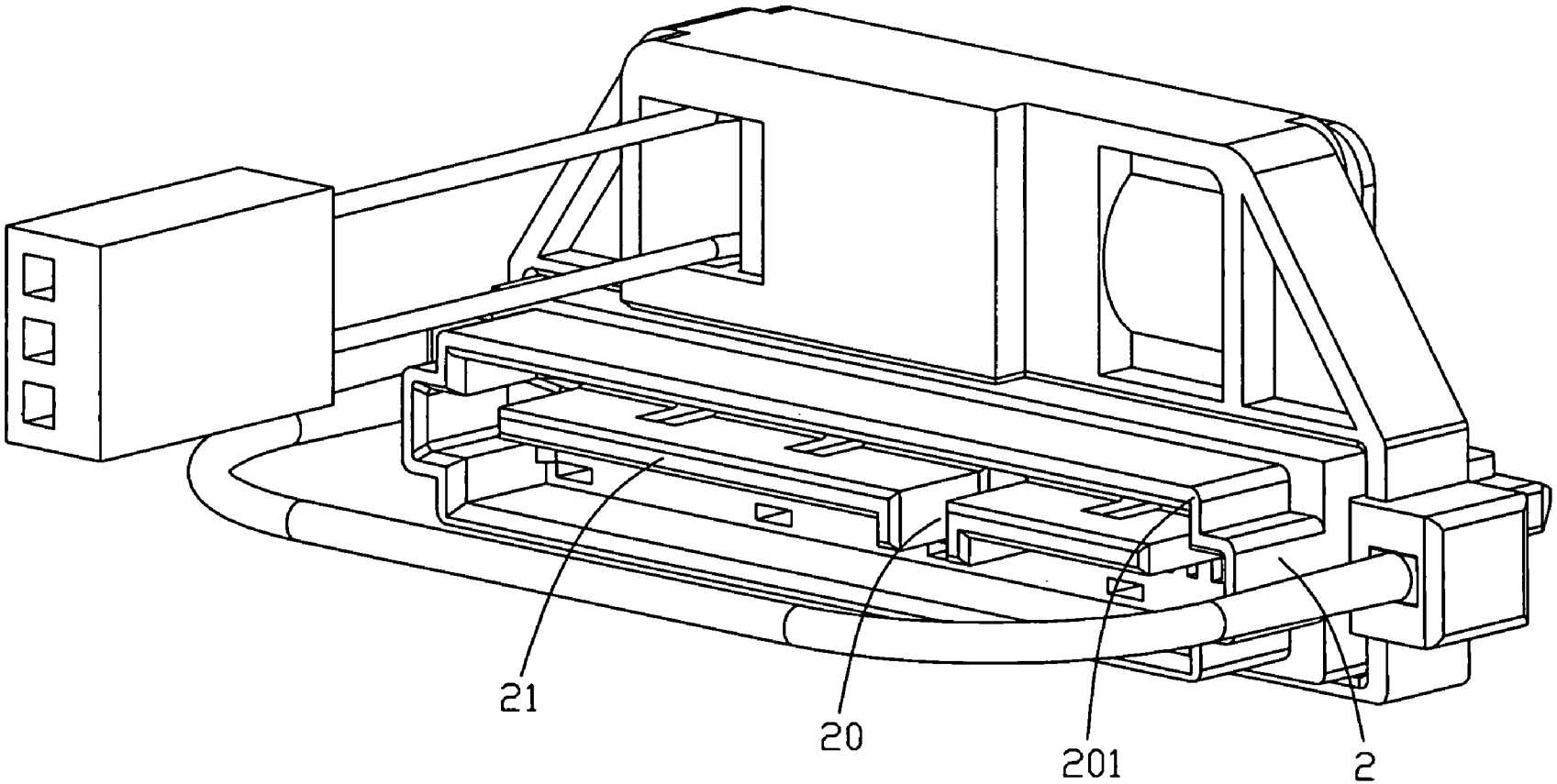
FIG. 2 is an assembled, perspective view of the sensor connector assembly of FIG. 1, but viewed from another aspect.
Figure 3:
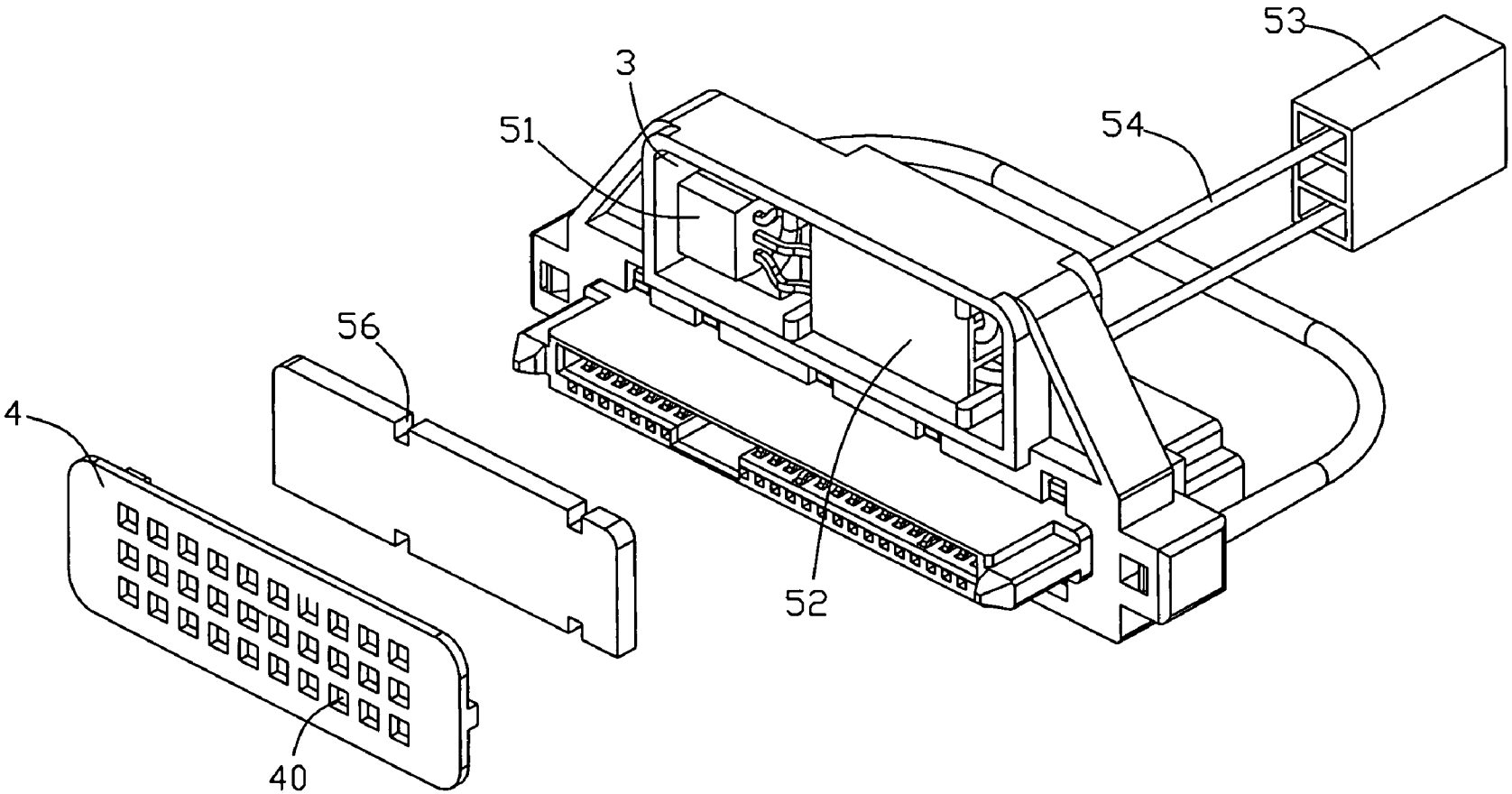
FIG. 3 is a partly-exploded, perspective view of the sensor connector assembly of FIG. 1.
Figure 4:
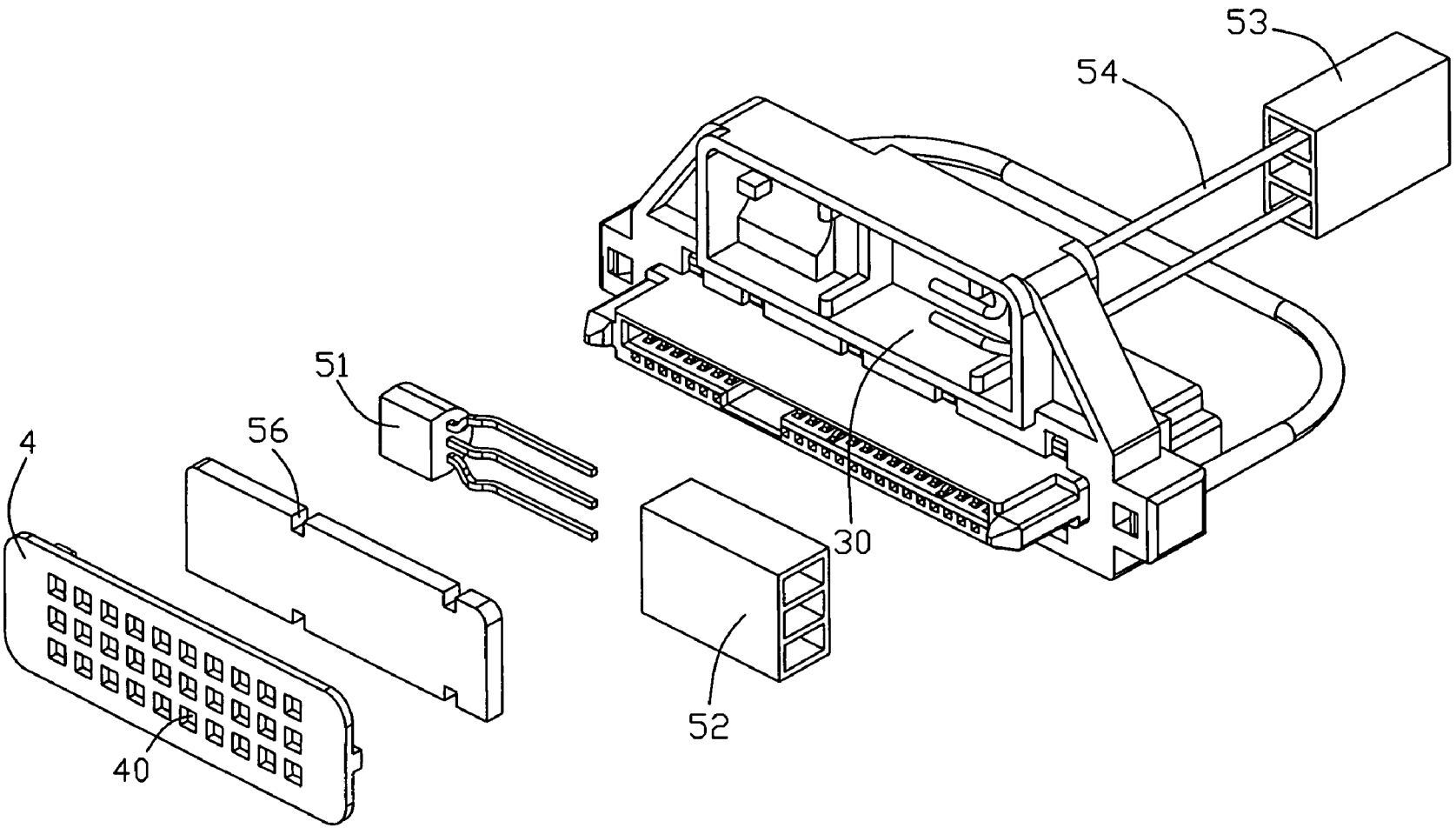
FIG. 4 is another partly-exploded, perspective view of the sensor connector assembly of FIG. 1.

Referring to FIGS. 1-2 in conjunction with FIGS. 3-4, a sensor connector assembly in accordance with a preferred embodiment of the present invention includes an extender having a first connector 1 and a second connector 2 electrically connected and disposed in a back-to-back relationship with each other, a chamber or receptacle 3 standing upon a top wall 30 of a base of the extender, a thermal sensing device received in the chamber 3, and a cover 4 assembled onto the chamber 3 for covering the thermal sensing device, wherein the cover 4 defines a plurality of through holes 40 to communicate the thermal sensing device with the outside.

Figure 5:
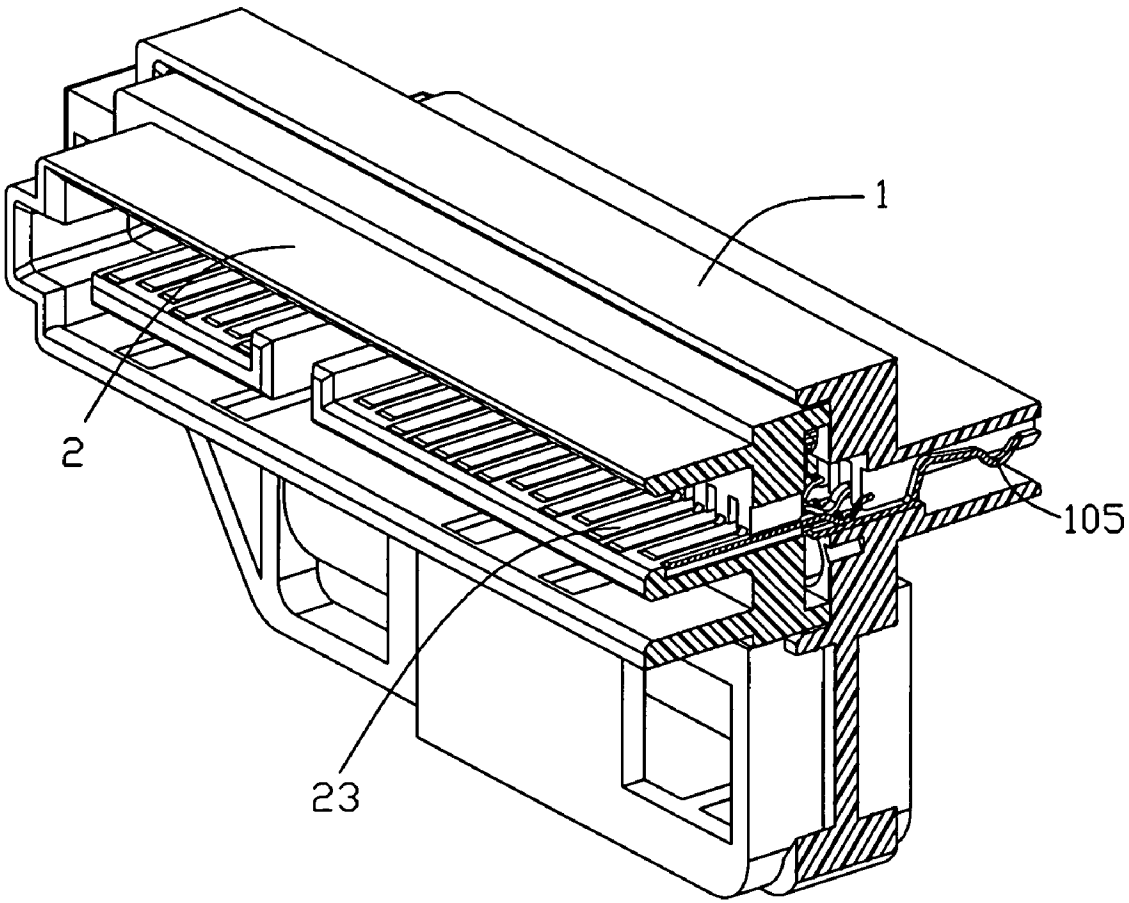
FIG. 5 is a cross sectional view of a part of the sensor connector assembly of FIG. 1.

Referring to FIG. 1, the first connector 1 has a connector body including a first forward mating port 10 defined on a first mating face 101, a plurality of terminal passageways 103 formed in the connector body to communicate with the first mating port 10, a plurality of terminals received in the respective terminal passageways 103 with contact sections 105 exposed in the first mating port. Referring to FIG. 2, the second connector 2 has a base including a mating tongue 21 exposed in a second mating port 20 defined on a second mating face 201, and a plurality of contacts 23 disposed on a same face of the mating tongue 21, wherein the second mating face 201 is different from the first mating face 101. Referring to FIG. 5, the second connector 2 is electrically connected with the first connector 1 by the terminals of the first connector 1 engaging with the contacts 23 of the second connector 2. In this preferred embodiment, the chamber 3 is configured to stand upon the top wall 30 of the connector body of the first connector 1. In alternative embodiments, the chamber 3 may be defined on any wall of the first connector 1 or second connector 2, or walls of both of the first and second connectors.

Referring to FIGS. 3-4, the thermal sensing device includes a thermal transistor 51, a first thermal connector 52 having one end electrically connected to the thermal transistor 51 and another end electrically connected to a cable 54, a second thermal connector 53 disposed transverse to the first thermal connector 52 and electrically connected with the first thermal connector 52 by the cable 54, and a thermal pad 56 located outward of the thermal transistor 51 and the first thermal connector 52 to communicate with the outside and adapted to conduct the outside heat to the thermal transistor 51, wherein an entrance of the chamber 3 at one side is walled up by the thermal pad 56. The cover 4 is further assembled onto the outmost of the chamber 3 to cover or protect the thermal pad 56, with thereof a plurality of through holes 40 for transmitting the outside heat to the thermal pad 56. This thermal sensing device is configured to measure or sense the temperature of a specific position where the connector assembly is located so as to decide when to startup a cooling system for the connector assembly. When the temperature of the specific position where the connector assembly is located, is within a predetermined range measured by the thermal sensing device, the cooling system for the connector assembly is not enabled so as to have power savings. When the measured temperature is beyond a predetermined temperature, which will influence the normal operation of the electrical connector assembly, the cooling system for the connector assembly is enabled for temperature reduction to assure the normal operation of the electrical connector assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A sensor connector assembly, comprising:

an extender, comprising:

a first connector having a connector body including a first forward mating port, a plurality of terminal passageways formed in the connector body to communicate with the first mating port, a plurality of terminals received in the respective terminal passageways with contact sections exposed in the first mating port; and a second connector electrically connected and disposed in a back-to-back relationship with the first connector, the second connector having a base including a mating tongue exposed in a second mating port, a plurality of contacts disposed on a same face of the mating tongue;

a receptacle defined upon a top wall of at least one of the first and second connector;

a thermal sensing device received in the receptacle; and a cover assembled onto the receptacle for covering the thermal sensing device, the cover defining a plurality of through holes to communicate the thermal sensing device with the outside; wherein the thermal sensing device comprising a thermal transistor, a first thermal connector having one end electrically connected to the thermal transistor and another end electrically connected to a cable, and a thermal pad located outward of the thermal transistor and the thermal connector to communicate with the outside and adapted to conduct the outside heat to the thermal transistor; wherein an entrance of the receptacle at one side is walled up by the thermal pad.

2. A sensor connector assembly, comprising:

a connector body defining a first wall, a chamber defined on the first wall and;

a thermal sensing device received in the chamber, the thermal sensing device, comprising:

a thermal transistor;

a first thermal connector having one end electrically connected to the thermal transistor, and another end electrically connected to a cable; and a thermal pad located outward of the thermal transistor and the thermal connector to communicate with the outside, the thermal pad adapted to conduct the outside heat to the thermal transistor; and wherein an entrance of the chamber at one side is walled up by the thermal pad; wherein the connector body includes a forward mating port disposed in a suspension manner, a plurality of passageways formed in the connector body to communicate with the mating port.

3. The sensor connector assembly as recited in claim 2, further comprising a cover with thereof a plurality of through holes, the cover assembled onto the outmost of the chamber to cover the thermal pad.

4. The sensor connector assembly as recited in claim 2, further comprising a second thermal connector electrically connected to the first thermal connector by the cable, the second thermal connector disposed transverse to the first thermal connector.

5. A sensor connector assembly comprising:

a connector body defining a mating port to be coupled to a complementary connector for signal transmission;

a chamber integrally formed with the first connector and enclosing a thermal transistor equipped with a thermal pad which is communicative with an exterior where a heated air is produced due to said signal transmission;

a thermal connector located outside of the chamber while electrically connected to said transistor so as to initiate power to activating a cooling system for lowering a temperature of said exterior; wherein the thermal pad faces to said exterior in a direction which is same with that of the mating port to said exterior; wherein said connector body further defines another mating port communicating with the exterior in another direction opposite to said direction.

6. The sensor connector assembly as claimed in claim 5, wherein said thermal pad is covered by a cover plate having through holes therein.

7. The sensor connector assembly as claimed in claim 5, wherein said thermal connector is located by said chamber in another direction opposite to said direction.

8. The sensor connector assembly as claimed in claim 7, wherein said chamber is located between said two mating ports.

* * * * *